United States Patent [19]

Blauer

[11] 3,973,275

[45] Aug. 10, 1976

[54] ARMORED GARMENT

[76] Inventor: Maurice Blauer, 31 Dunbarton Road, Belmont, Mass. 02178

[22] Filed: Aug. 28, 1975

[21] Appl. No.: 608,653

[52] U.S. Cl. ..... 2/2.5
[51] Int. Cl.[2] ..... F41H 1/02
[58] Field of Search ..... 2/2, 2.5

[56] References Cited

UNITED STATES PATENTS

| | | | |
|---|---|---|---|
| 2,743,446 | 5/1956 | Persico et al. | 2/2.5 |
| 2,773,791 | 12/1956 | MacIver | 2/2.5 UX |
| 2,808,588 | 10/1957 | Persico | 2/2.5 |
| 2,954,563 | 10/1960 | De Grazia | 2/2.5 |
| 3,130,414 | 4/1964 | Bailey et al. | 2/2.5 |
| 3,452,362 | 7/1969 | Korolick et al. | 2/2.5 |
| 3,582,988 | 6/1971 | Armelliro | 2/2.5 |

*Primary Examiner*—Alfred R. Guest
*Attorney, Agent, or Firm*—Weingarten, Maxham & Schurgin

[57] ABSTRACT

An armored garment for protection of the torso from projectiles. The garment is comprised of unitary panels of pliable ballistic material capable of stopping bullets from most handguns. Double protection is provided for the front of the body where protection is most often required.

7 Claims, 6 Drawing Figures

ARMORED GARMENT

FIELD OF THE INVENTION

The present invention relates to armored vests, and more particularly to a concealed soft body armored vest which may be comfortably worn about the torso to provide constant protection against sudden handgun attack.

BACKGROUND OF THE INVENTION

Many attempts have been made to design satisfactory armored garments or so-called "bullet-proof" vests. In the past, many of these garments have been specifically designed for use by combat infantry and hence have concentrated on attempting to provide lightweight, flexible garments which would protect foot soldiers against both relatively large low energy missiles such as from fragmentation bombs, grenades and land mines, and smaller high energy projectiles such as from small arms. To provide adequate protection against such a variety of missiles, prior armored clothing for military use has often employed vests with a plurality of specially arranged pockets designed to receive rigid, usual metal, armor plates.

Certain examples of the prior art use a small number of relatively large armored plates to cover large sections of the body. Armored vests made with these large rigid plates are relatively bulky and heavy, tend to restrict mobility, and may fail to protect the body against transient deformation effects resulting when the armor is struck but not penetrated. An example of this type of armored vest is shown in U.S. Pat. No. 3,452,362.

Other attempts have been made to provide satisfactory armored garments using a number of smaller overlapping plates arranged inside specially designed pockets in a vest. In order to provide more mobility to the user, the pockets are suspended from the vest to allow the overlapping plates to move with respect to one another in more than one direction without leaving gaps through which a projectile could pass to hit the wearer's body. While these multi-plate armored garments provide some relief from the rigidity of prior vests, the method of attaching the plates to the vest is complicated and expensive. Also, these vests are usually bulky and therefore would not be satisfactory for concealed long-term use such as by a regular duty police officer. U.S. Pat. No. 2,747,190 discloses an armored vest of this type.

Because of recent advances in the design and manufacture of ballistic textile material, it has become possible to provide flak or fragmentation protection jackets which are relatively lightweight. However, in vests of this type, the body of the garment is relatively thick or stiff or both so that the wearer is considerably restricted in the movement of his arms, as for instance in the handling of a firearm or the like. A number of attempts have been made to provide flexibility to this type of garment by including flexible flaps and special closures. Examples of this type of armored clothing are disclosed in U.S. Pat. No. 2,743,446 which shows the use of flexible material at the front closure of the jacket, U.S. Pat. No. 2,808,588 which extends the flexibility to the back panels, and U.S. Pat. No. 2,954,563 disclosing a special feathered front closure. Most of these garments are designed for military use and provide adequate protection against low energy, relatively large fragmentation-type missiles. However, to provide satisfactory protection against small arms fire, a substantial amount of heavier material has been required. This additional heavy equipment constitutes a substantially impossible burden for the foot soldier, reducing his efficiency and possibly causing him to become a casualty as a result of fatigue or heat exhaustion.

The armor plated vests and even the soft body armor of the prior art provide satisfactory protection to the body. Their weight and bulk can be tolerated for short periods of time and in situations where attack may be imminent, for example, military combat, riot control or in emergency civilian police situations where an officer can expect to be attacked by known armed suspects.

Until now there has not been available a lightweight, flexible body armor that may be comfortably and unobtrusively worn under ordinary clothing or as part of an ordinary jacket for long periods of time by regular duty officers to protect them against sudden, unexpected handgun attack. Even on routine duty, the police officer may be a target of such unexpected attack by armed individuals. In such situations, the law enforcement officer would not have sufficient warning to protect himself with armor plated garments of the prior art, and because he is on duty for long periods of time, he could not comfortably or realistically wear such heavy and bulky garments as part of his regular uniform.

SUMMARY OF THE INVENTION

The present invention provides a soft body armor that may be comfortably worn for long periods of time by regular duty police officers. This unitary vest is made of a plurality of panels of continuous multi-ply ballistic fabric enclosed within a tough covering layer, such as nylon twill, providing protection encircling the entire torso. This garment has none of the undesirable intervening seams, gaps or joints between overlapping or abutting armored plates common to the prior art body armor, through which a projectile may pass to hit the user's body.

The vest of this invention includes a single back panel extending from the shoulders to the waist and part way around the sides. It is secured at the shoulders to two separate side-front panels, also extending from the shoulders over the lateral portions of the chest and ribs to the waist and part way around the sides. Side-wise extensions of the front and back panels are held in constantly overlapping relationship around the sides of the torso by elastic bands. Two overlapping central-front panels attached to the side-front panels close securely over the wearer's chest and stomach by means of cooperating strips of hook and pile fasteners, sold under the trademark VELCRO, to provide protection completely around the wearer's torso. The overlapping front panels are designed to double the wearer's protection across the front of the body to protect heart, lung, kidneys, spleen and spine from sudden frontal attack even at close range with one of the world's most powerful handguns, the .44 Magnum. At the back and sides, the wearer is protected by the single thickness of the vest which will stop a close range shot from a .38 caliber Police Special. While providing the life saving protection of the military-type armor plated vests of the prior art, the present invention is lightweight, easy to wear and has many of the attributes of ordinary clothing while being nearly as unobtrusive.

The vest of this invention is lightweight and allows full freedom of movement. A preferred embodiment of this garment weighs only 4.5 pounds. The elastic connection between the front and back side-wise extensions hold the vest together to provide complete protection to the torso while allowing the vest to adjust automatically to the body shape and movement. The vest is sufficiently lightweight to be comfortable to work in throughout the year. As a zip-in liner to a jacket, it provides warmth as well as protection during the fall, winter and spring months and during the summer it can be worn under a shirt or outer police uniform blouse. Since the vest uses no armor plates or even metal mesh, it may be easily manufactured to provide a well-tailored fit so that there are no telltale bulges. The vest is completely washable and the nylon twill cover is tough and wear-resistant.

BRIEF DESCRIPTION OF THE DRAWING

The object, advantages and features of the invention will be more fully understood from the following detailed description when taken in conjunction with the accompanying drawing in which.

DETAILED DESCRIPTION OF THE PREFERRED EMBODIMENT

Figure 1:
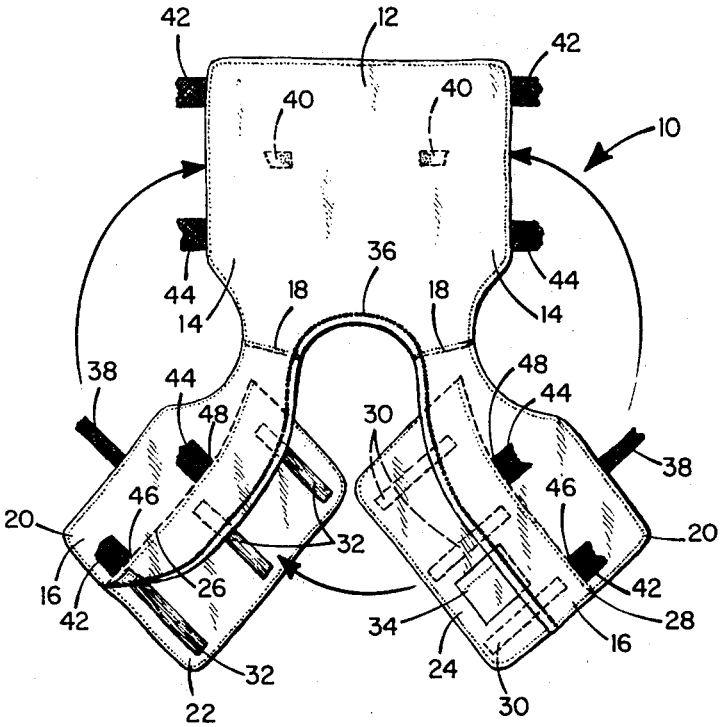
FIG. 1 is a plan view of the armored vest of the present invention with the panels separated in order for the garment to lie flat.

Referring now to FIG. 1, there is shown a plan view of a blank 10 from which the soft body armored garment of the present invention is fabricated. Back panel 12 extends straight down from the shoulders to the waist and is yoked at the shoulders to accommodate the neck of the user. The back panel 12 includes two forward extensions 14 extending from just under the arm or axilla of the wearer to the waist. Two side-front panels 16 extend from the shoulders over the lateral portions of the chest and ribs to the waist and are sewn to the back panel 12 by means of a heavy seam 18 along the shoulder. It is also possible that the back and side-front panels could be made in a single unit so that seam 18 would not be necessary. The side-front panels 16 each include a rearward extension 20 extending from just under the arm of the wearer to the waist. Two central-front panels 22 and 24 are sewn to the inside of the respective side-front panels 16 by a multiple seam of heavy thread 26 and 28 respectively. Cooperating strips of hook 30 and pile 32 fastening material, marketed under the trademark VELCRO, are secured on the facing surfaces of the central-front panels 22 and 24 so that they may be secured to one another in an overlapping fashion to close the front of the vest over the user's chest and stomach. This overlapping front closure provides a double thickness of ballistic material to give added protection to the vital organs against sudden frontal attack. An optional utility pocket 34 may be provided on the outside of the outer overlapping central-front panel.

As another optional feature, the side-front panels 16 may each be configured to provide support for one-half of zipper 36 extending along the edge of the side-front panels and around the yoke of the neck so that the entire garment may be easily zipped into an outer jacket wherein a mating portion of a zipper is secured.

Each panel of the soft body armored garment of the present invention is manufactured from a continuous piece of ballistic material such as eight-ply fabric PRD-494 (type 29, sold under the trademark KEVLAR) extending from edge to edge of the cloth which comprises the entire outer surface of the vest. There are no voids nor unprotected seams through which a projectile may hit the wearer's body. Strong, heavy thread is used at the edges of each unitary panel and to interconnect panels together such as at the shoulders. Of course the number of plies of ballistic and covering material, the type of thread and the number of seams are not important to the invention. It is only necessary that the specifications be properly met.

On each side of the vest an elastic band 38 is connected to the rear edge of the side-front panel 16 and to the inside of the back panel 12 at a point 40, preferably well inside the edge. A pair of elastic bands 42 and 44 extend from the edges of the forward extensions 14 of the back panel and are attached at points 46 and 48 respectively on the front surface of the side-front panel 16 well inside the edge. These elastic bands insure that the extensions 14 and 20 of the back and side-front panels 12 and 16 respectively are always disposed in overlapping relationship and they permit the vest to adjust automatically to the body shape and movement without leaving a gap through which a projectile could strike the user's body. It should be realized that the number of elastic bands and their point of attachment makes little difference as long as the necessary overlap and flexibility is maintained.

Figure 2:
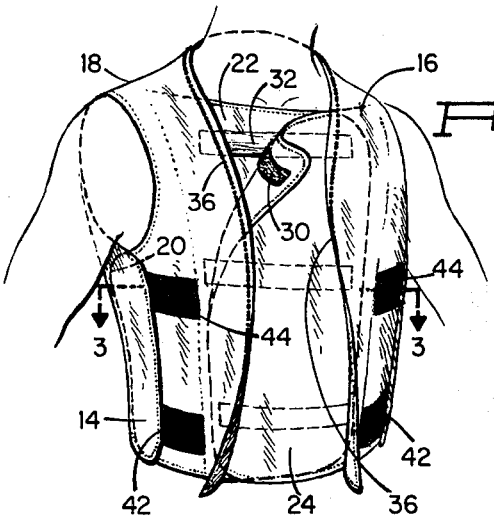
FIG. 2 shows the armored vest of FIG. 1 displayed on a mannequin.

Referring now to FIG. 2, there is shown the armored vest blank 10 of FIG. 1 fashioned into a completed garment and displayed on a mannequin. It can be seen that this is a close fitting tailored garment that can be comfortably worn for long periods of time. A plurality of VELCRO strips 30 and 32 hold the overlapping central-front panels 22 and 24 securely closed over the chest and stomach and prevent the panels from sliding with respect to one another or moving out of place or inadvertently opening up even during the very vigorous activity that might be expected during an attack. However, the vest may be easily and quickly donned and doffed if necessary. The elastic bands 38, 42 and 44 hold the extensions 14 and 20 of the respective back and side-front panels 12 and 16 tightly against the body with a margin of overlap to allow the vest to adjust automatically to body shape and movement without leaving any dangerous gap to expose the user's body.

Figure 3:
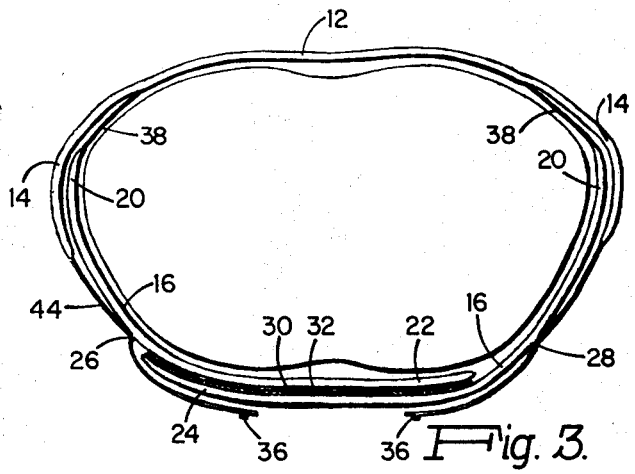
FIG. 3 is a cross section of the vest and mannequin taken along cutting plane 3—3 of FIG. 2.

Referring now to FIG. 3, there is shown a cross section of the vest and the mannequin's torso of FIG. 1. It may be clearly seen that the armored vest of the present invention completely encircles the torso to provide protection against handgun attack from any direction and to provide doubly effective protection for the vital organs against frontal attack. The manner in which the elastic bands 38, 42 and 44 cooperate to provide a flexible overlapping side closure for the vest may be plainly observed from FIG. 3. The overlapping front closure and the double protection provided by central-front panels 22 and 24 is also clearly shown.

The soft body armored garment of the present invention provides comfortable concealed protection even against the most powerful of handguns. For the specific example shown, the overlapping flap design doubles the user's protection across the front of his body with 16 plies of ballistic fabric and covered on both sides by two-ply, 4 oz. nylon twill cover cloth. With eight protective plies on the underflap and eight plies on the overflap, the user is protected even against the force of a .44 Magnum at ten foot range. The back is protected by eight-ply thickness and will stop a shot from a .38 caliber Police Special, a .22 caliber pistol or comparable handgun bullets moving at muzzle velocities up to 1,000 feet per second.

Figure 4A:
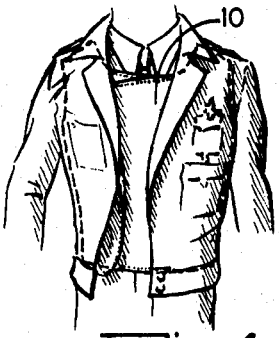
FIGS. 4A, 4B and 4C depict a torso as it would appear with the vest of FIG. 1 worn respectively as a zip-in liner to a jacket, under a police uniform blouse and under a shirt.
Figure 4B:
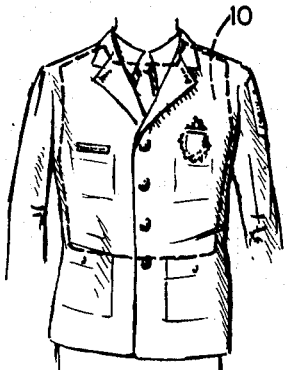
Figure 4C:
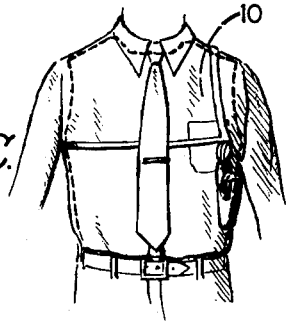

Yet, the soft body armor of this invention has many of the characteristics of ordinary clothing in that it is lightweight, is completely washable and can be tailored to fit the individual user so that it can be worn comfortably without telltale bulges. It can be worn as the zipped-in liner for an ordinary jacket during the fall, winter and spring months (FIG. 4A) and under a uniform blouse (FIG. 4B) or shirt (FIG. 4C) during the summer months. Note that the cooperating portions of zipper 36 are shown in FIG. 4A.

The material used in the present soft body armor garment has been proved to be effective protection by tests conducted at the U.S. Army's Edgewood Arsenal in Edgewood, Md., using National Bureau of Standard's official testing distances. Examples of these test results are set forth below:

EXAMPLE 1

A 9 mm. pistol was used to fire a 124 grain, full metal jacket bullet with a muzzle velocity of approximately 1,433 feet per second at the 16-ply front of the vest. The bullet penetrated eight plies of fabric and was found on the ninth ply.

EXAMPLE 2

A .357 Magnum pistol was used to fire a 158 grain, full metal jacket bullet with a muzzle velocity of appoximately 1,282 feet per second at the 16-ply front of the vest. The bullet penetrated through the eighth ply.

EXAMPLE 3

A .44 caliber Magnum pistol was fired at the 16-ply front of the vest with a muzzle velocity approximately 1,450 feet per second. The bullet was found in the ninth ply.

EXAMPLE 4

A .38 caliber Police Special pistol was used to fire a 158 grain, full metal jacket bullet with a muzzle velocity of approximately 866 feet per second into the eight-ply back of the vest of the present invention. The bullet bounced off the vest and in a second test run under the same conditions, the bullet stopped underneath the cover fabric.

It will be apparent to those skilled in the art that changes and improvements may be made to the above-described preferred embodiment without departing from the spirit of this invention. While the preferred embodiment shown is comprised of separately delineated panels: back, side-front and central-front, it is possible that the entire vest could be made as a single unitary garment including all of the panels mentioned. In that case, the panels would not technically be secured to one another but would be an integral part of the adjacent panel. Accordingly, the invention is not to be limited by the particular implementations shown and described, except as indicated in the claims which follow.

What is claimed is:

1. An armored garment for protection of a wearer from injury by projectiles, said garment comprising:

a unitary back panel configured to cover the width of the back and extending from the shoulders to the waist of a wearer, said back panel having forward extensions on each side to cover the sides of the wearer between the axilla and the waist;

a unitary left side-front panel secured to said back panel at the left shoulder and configured to extend from the shoulder over the lateral portion of the wearer's chest and ribs to the waist, said left side-front panel having a rearward extension to cover the wearer's left side between the axilla and the waist;

a unitary right side-front panel secured to said back panel at the right shoulder and configured to extend from the shoulder over the lateral portion of the wearer's chest and ribs to the waist, said right side-front panel having a rearward extension to cover the wearer's right side between the axilla and the waist;

means for flexibly securing said side-front panels to said back panel at the sides in sliding overlapping relationship;

a unitary left central-front panel secured to said left said-front panel and configured to extend from the neck to the waist over the wearer's chest and stomach;

a unitary right central-front panel secured to said right side-front panel and configured to extend from the neck to the waist over the wearer's chest and stomach; and means for removably securing said left and right central-front panels in overlapping relationship over the wearer's chest and stomach to close the vest completely around the wearer's torso and to provide double thickness protection therefor;

each of said back, left and right side-front and left and right central-front panels being formed of multiple layers of ballistic fabric material enclosed by at least one layer of tough, wear-resistant cover fabric.

2. The garment according to claim 1 and further comprising:

a left flap extending laterally from said left side-front panel partially overlapping said left central-front panel;

a right flap extending laterally from said right side-front panel partially overlapping said right central-front panel; and means attached to the edge of said right and left flaps for securing said vest inside a jacket as a lining therefor.

3. The garment according to claim 2 wherein said means for securing said garment to a jacket comprises a zipper wherein one portion of said zipper is mounted to said right and left flaps and another portion of said zipper is mounted to said jacket.

4. The garment according to claim 1 wherein said means for securing said left and right central-front panels together comprises a plurality of cooperating strips of hook and pile fasteners disposed in discrete areas on the overlapping surfaces of said left and right central-front panels.

5. The garment according to claim 1 wherein said means for flexibly securing said side-front panels to said back panel comprises a plurality of elastic bands.

6. The garment according to claim 5 wherein said plurality of elastic bands comprises:

at least one first left elastic band having one end secured to said back panel at a point spaced from the forward edges of said left forward extension, the other end of said first left elastic band being secured to the rearward edge of said left rearward extension of said left side-front panel;

at least one first right elastic band having one end secured to said back panel at a point spaced from the forward edges of said right forward extension, the other end of said first right elastic band being secured to the rearward edge of said right rearward extension of said right side-front panel;

at least one second left elastic band having one end secured to said left side-front panel at a point spaced from the rearward edges of said left rearward extension, the other end of said second left elastic band being secured to the forward edge of said left forward extension of said back panel; and at least one second right elastic band having one end secured to said right side-front panel at a point spaced from the rearward edge of said right rearward extension, the other end of said second right elastic band being secured to the forward edge of said right forward extension of said back panel.

7. An armored garment for protection of a wearer from injury by projectiles, said garment comprising:

a plurality of panels formed of multiple layers of continuous ballistic material fashioned into a unitary front opening vest configured to completely cover the back, sides and front portions of the wearer's torso from the shoulders and axilla to the waist, said vest having an opening for each arm and for the neck of the wearer;

cover fabric over the ballistic material of said vest;

closure means for securing two of said panels in overlapping relationship across the wearer's chest and stomach.

* * * * *

UNITED STATES PATENT AND TRADEMARK OFFICE

CERTIFICATE OF CORRECTION

PATENT NO. : 3,973,275

DATED : August 10, 1976

INVENTOR(S) : Maurice Blauer

It is certified that error appears in the above–identified patent and that said Letters Patent are hereby corrected as shown below:

Column 2, line 18, "regular duty officers" should read --regular duty police officers--.

Column 8, line 20, "stomach." should read --stomach; and means for disposing said panels about the wearer's sides in flexible overlapping relationship from the axilla to the waist to provide a close fitting garment automatically adjustable to body shape and motion.--

Signed and Sealed this

Seventh Day of December 1976

[SEAL]

*Attest:*

RUTH C. MASON
*Attesting Officer*

C. MARSHALL DANN
*Commissioner of Patents and Trademarks*